US007602115B2

(12) United States Patent
Weiland et al.

(10) Patent No.: US 7,602,115 B2
(45) Date of Patent: Oct. 13, 2009

(54) ELECTRODE SYSTEM WITH A CURRENT FEEDTHROUGH THROUGH A CERAMIC COMPONENT

(75) Inventors: Reinhold Weiland, Neuberg (DE); Harald Manhardt, Bruchköbel (DE); David Lupton, Gelnhausen (DE)

(73) Assignee: W.C. Heraeus GmbH, Hanau (DE)

( * ) Notice: Subject to any disclaimer, the term of this patent is extended or adjusted under 35 U.S.C. 154(b) by 415 days.

(21) Appl. No.: 11/090,423

(22) Filed: Mar. 25, 2005

(65) Prior Publication Data

US 2005/0212431 A1 Sep. 29, 2005

(30) Foreign Application Priority Data

Mar. 26, 2004 (DE) ..... 10 2004 015 467

(51) Int. Cl.
*H01J 17/18* (2006.01)

(52) U.S. Cl. ..... 313/497; 313/623; 313/624; 313/625; 445/26; 445/27

(58) Field of Classification Search ..... 313/497, 313/623–625, 634–636, 493, 318.12, 570, 313/578; 118/50; 445/26, 27
See application file for complete search history.

(56) References Cited

U.S. PATENT DOCUMENTS 5,552,670 A 9/1996 Heider et al.
5,783,912 A * 7/1998 Cocoma et al. ..... 315/248
6,215,254 B1 * 4/2001 Honda et al. ..... 315/246
2002/0030446 A1 * 3/2002 Scholz et al. ..... 313/636
2003/0141797 A1 * 7/2003 Isida et al. ..... 313/284

FOREIGN PATENT DOCUMENTS

| | | | |
|---|---|---|---|
| DE | 41 27 555 | A1 | 2/1993 |
| DE | 199 08 688 | A1 | 8/2000 |
| DE | 102 26 762 | A1 | 12/2003 |
| EP | 0 528 428 | B1 | 1/1996 |
| EP | 0 609 477 | B1 | 5/1999 |
| EP | 1 195 214 | A1 | 4/2002 |
| EP | 1 339 092 | A2 | 8/2003 |
| WO | WO 03/096377 | A1 | 11/2003 |
| WO | WO 03096377 | A1 * | 11/2003 |

* cited by examiner

*Primary Examiner*—Joseph L Williams
*Assistant Examiner*—Elmito Breval
(74) *Attorney, Agent, or Firm*—Panitch Schwarze Belisario & Nadel LLP

(57) ABSTRACT

An electrode system with a current feedthrough through a ceramic discharge vessel is provided which, on one hand, increases the visible output of lamps and, on the other hand, allows smaller dimensions. For this purpose, the current feedthrough is made of rhenium or a platinum-group metal. In this way, improved color reproduction is also achievable. In preferred embodiments: (a) the current feedthrough is made of rhenium or a rhenium alloy or a platinum-group metal or a platinum-group metal alloy and the current feedthrough is brazed flush in the discharge vessel, (b) the discharge vessel has no shaft, and/or (3) the current feedthrough is in the form of one or more joined spheres.

6 Claims, 3 Drawing Sheets

ELECTRODE SYSTEM WITH A CURRENT FEEDTHROUGH THROUGH A CERAMIC COMPONENT

BACKGROUND OF THE INVENTION

The present invention relates to an electrode system for a discharge lamp with a ceramic discharge vessel comprising an electrode, a current supply line, and a current feedthrough, which is guided through the ceramic discharge vessel and which comprises a platinum-group metal or rhenium. The present invention also relates to a method for fabricating an electrode system, in which a platinum group metal-based or rhenium-based current feedthrough is brazed flush in the ceramic component with a metallic braze. In addition, the invention relates to a preferred ceramic discharge vessel for the electrode system, as well as to the use of the electrode system or the preferred discharge vessel in metal halide lamps.

An electrode system for a metal halide lamp is known from German published patent application DE 102 26 762 A1, comprising a ceramic discharge vessel, an electrically conductive feedthrough, and an electrode. The construction is designed for high operating temperatures. However, the light output of a lamp is limited by its dimensions.

BRIEF SUMMARY OF THE INVENTION

Objects of the present invention are, on the one hand, to increase the light output of lamps and, on the other hand, to allow smaller dimensions.

These objects are achieved according to the invention in that the current feedthrough through the ceramic discharge vessel comprises rhenium or platinum-group metal metals. In particular, the current feedthrough is composed of rhenium or a platinum-group metal or a rhenium or platinum-group metal alloy.

In this way, the invention can be used for metal halide lamps with increased light efficiency. Smaller lamps with improved light efficiency can be fabricated with the electrode system. The electrode system according to the invention withstands temperatures up to 2000° C. in the area of the current feedthrough. Consequently, improved color reproduction can also be achieved.

Furthermore, according to the invention the discharge vessel can be equipped without a shaft for the current feedthrough. This enables, in turn, a further reduction of the lamp dimensions.

In a synergistic way, the inventive technology enables the production of lamps with increased radiation output, improved color reproduction, and considerable reduction of the dimensions.

In a preferred embodiment, the current feedthrough is brazed into the ceramic discharge vessel with a platinum-group metal braze.

Further preferred embodiments include the following features, either alone or together:

the electrode is tungsten;

the current supply line is a non-noble metal pin;

rhenium or a platinum-group metal is a significant portion, the main component, or the predominant portion of the current feedthrough;

the current feedthrough comprises rhenium or a rhenium alloy or a platinum-group metal or a platinum-group metal alloy, especially iridium or an iridium alloy;

the ceramic discharge vessel comprises aluminum oxide; and flush brazing of the current feedthrough in the discharge vessel.

The design of the current feedthrough in the form of one or more joined spheres allows an economical production of the electrode system, especially if the current feedthrough comprises a platinum-group metal or rhenium or their alloys. Furthermore, the embodiment of the current feedthrough in spherical form has proven to be advantageous for mass production.

In a preferred embodiment, the current feedthrough comprises two joined spheres made of a platinum-group metal or rhenium, or their alloys, wherein the intermediate space between the spheres and the wall of the discharge vessel is filled with a platinum group metal-based braze.

The combination of a current feedthrough resistant up to 2000° C., according to the invention, and the direct brazing of the current feedthrough with a ceramic burner enables a compact, new design of the ceramic burner with optimized light efficiency and reduced metal halide content.

This current feedthrough no longer requires any projecting length beyond the width of the vessel wall. According to the invention, the elimination of this shaft enables a direct reduction of the lamp dimensions for comparable output of lamps with comparable temperature. Therefore, for the production of small lamps, the output increase plays a role on the temperature increase. In a preferred embodiment, the discharge vessel is shortened by eliminating the shafts, which are conventionally arranged for receiving the current feedthrough.

A current supply line pin can optionally be arranged between the current supply line and the current feedthrough and can electrically connect these parts to each other.

The ceramic discharge vessel can be designed as a burner and can comprise $Al_2O_3$, sapphire, yttrium aluminum garnet, aluminum nitride, aluminum oxynitride, silicon aluminum oxynitride, or especially can comprise $Al_2O_3$.

The current feedthrough penetrates the wall of the ceramic discharge vessel in a gas-tight manner and connects the electrode to the current supply line or to the current supply line pin. According to the invention, the current feedthrough contains rhenium or a platinum-group metal. Preferably, alloys of these metals are used, and current feedthroughs are especially made of Ir (iridium) or an Ir alloy.

Preferably, the braze is brazed flush with the current feedthrough and the wall of the discharge vessel. A braze made of a platinum-group metal or its alloy is very suitable for this purpose.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
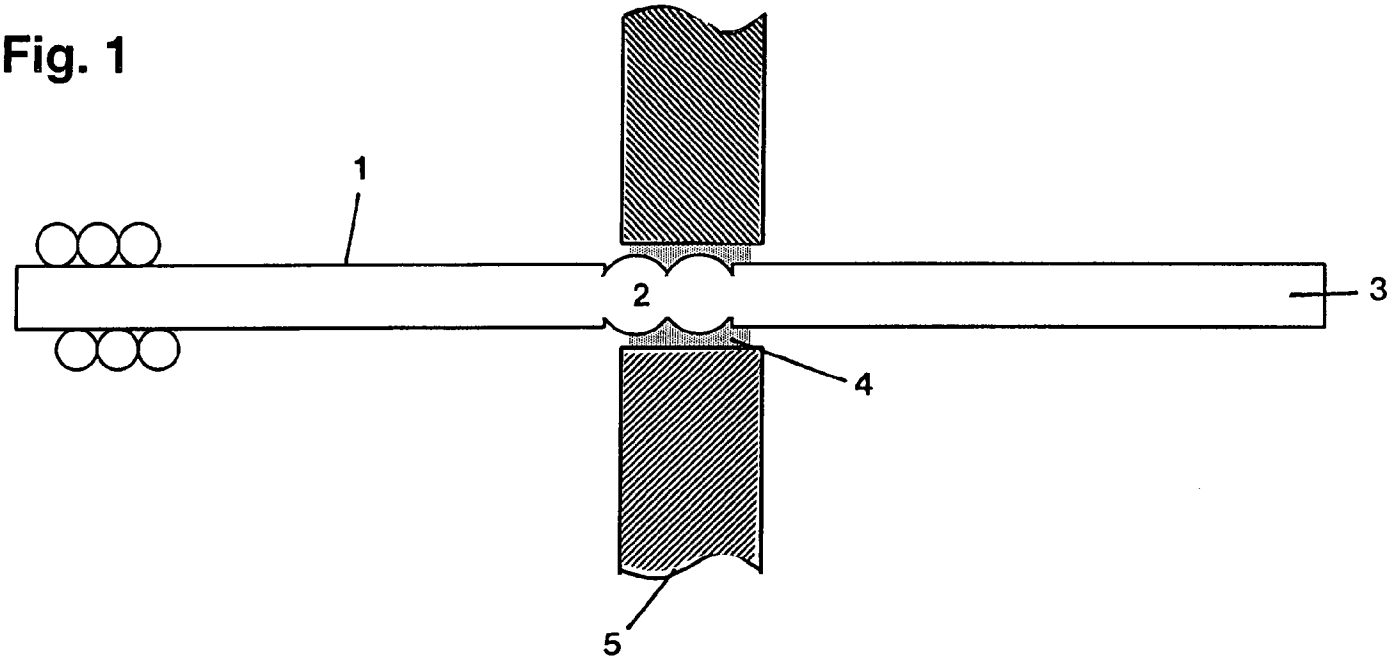
FIG. 1 is a cross section of a portion of a ceramic ($Al_2O_3$) discharge vessel wall having an electrode system according to the invention for use in metal halide lamps.
Figure 1A:
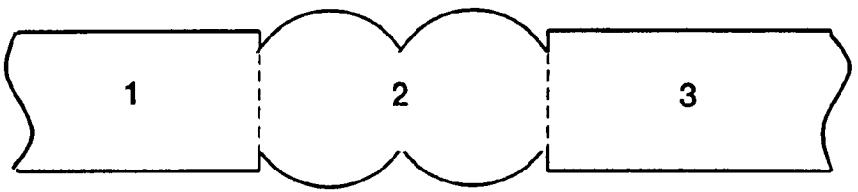
FIG. 1A is an enlarged detail view of FIG. 1, showing the current feedthrough connection to the electrode and current supply line.
Figure 2:
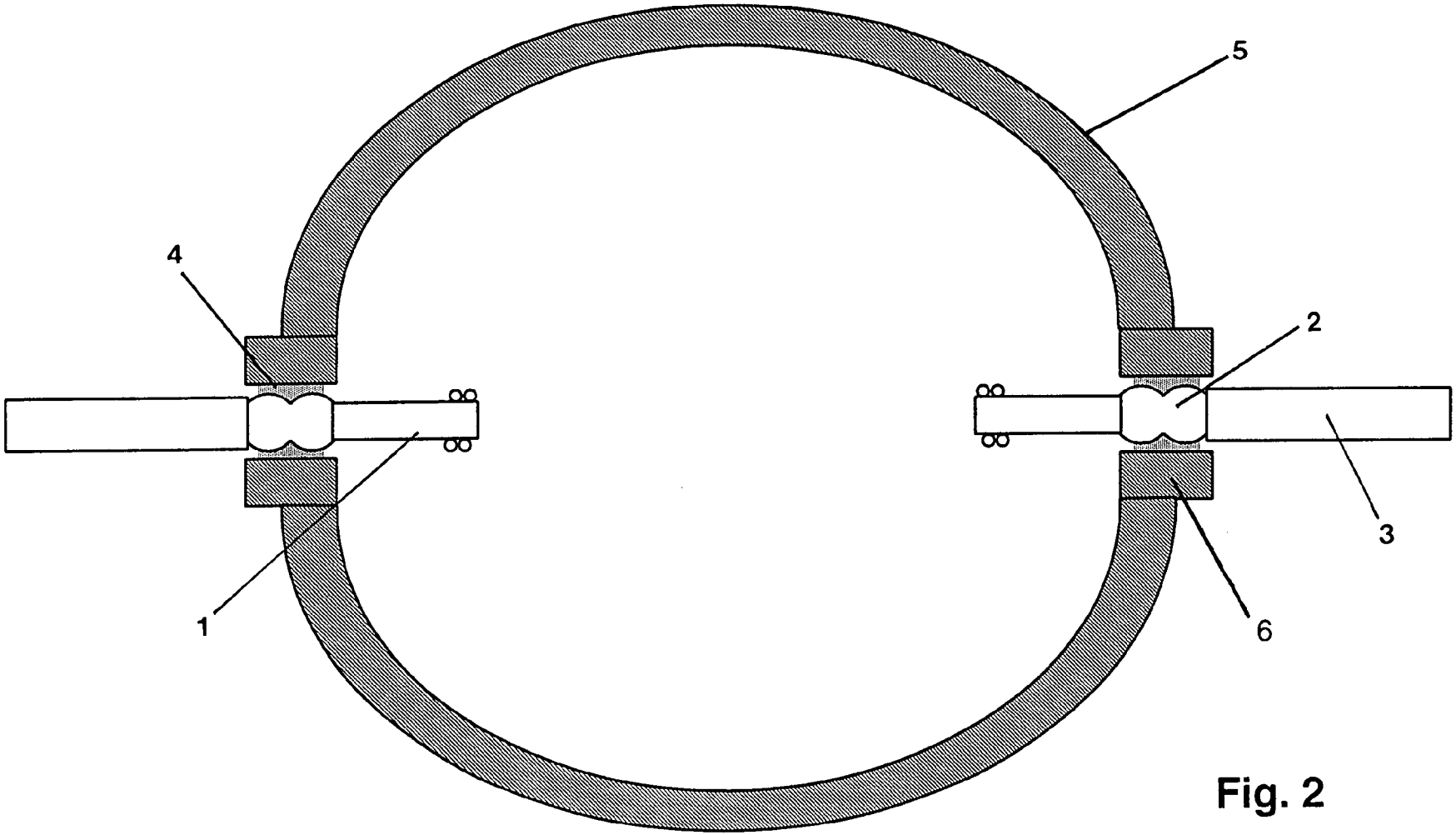
FIG. 2 is a cross section of the ceramic discharge vessel with an integrated electrode system according to the invention.

As shown in FIGS. 1, 1A and 2, the electrode system of the invention comprises an electrode 1, like those typically used in discharge lamps, a current supply line 3, which can be formed as or with a non-noble metal pin, and a current feedthrough 2. The current feedthrough 2 comprises rhenium or a platinum-group metal as essential components and comprises two joined spheres.

The joined spheres 2 together with a braze 4 fill the opening for the current feedthrough in the discharge vessel 5. Here, the current feedthrough 2 projects minimally into the discharge vessel 5, so that the electrode material of the electrode 1 does not come into contact with the discharge vessel 5. The interior of the discharge vessel 5 is closed tight with the braze.

The number of spheres is arbitrary. In an embodiment with one sphere, the braze 4 can be applied equally well on the electrode side or on the current supply line side or on both sides.

The current supply line 3 serves for the electrical connection between the lamp socket and the current feedthrough 2 through the wall of the ceramic discharge vessel 5. Preferably, a current supply line pin is provided for contact between the current supply line 3 and the current feedthrough 2. For metal halide lamps with conventional current feedthrough 2, this pin as a rule comprises an Nb alloy. For metal halide lamps with the current feedthrough 2 according to this invention, in addition to Nb alloys, other materials based on non-noble metals, including refractory metals, are also possible.

The discharge vessel 5 has no ceramic shaft in the region of the current feedthrough. However, slight reinforcements 6 in this region can be an advantage (FIG. 2).

By the use of a platinum group metal-based braze, as well as a platinum group metal-based or Re-based current feedthrough, higher temperatures up to about 1900° C. can arise in the region of the current feedthrough during the operation of the lamp, without leading to damage or negative effects on the functionality of the lamp. In turn, this enables the construction of lamps with a considerably more compact design (FIG. 2) than for conventional metal halide lamps (FIG. 3).

Figure 3:
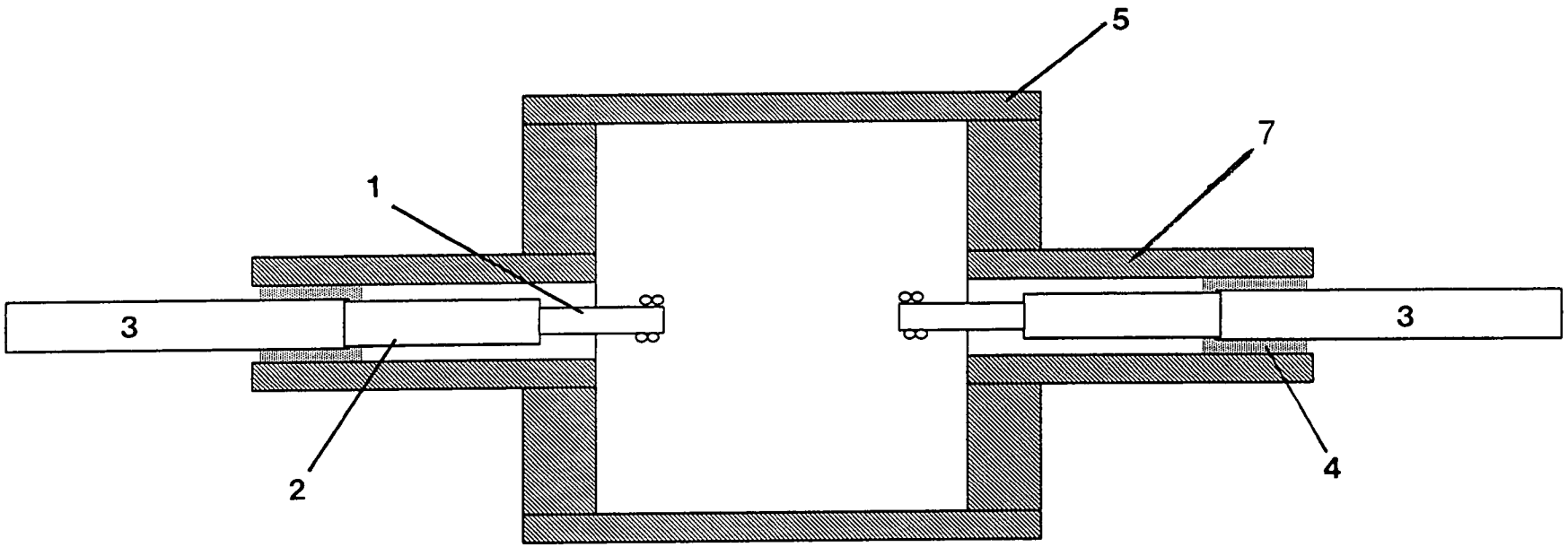
Fig. 3 PRIOR ART
FIG. 3 is cross section of a conventional discharge vessel having projecting shafts for the current feedthrough.

From FIG. 3, it can be seen that the conventional lamp design requires on each end of the ceramic discharge vessel an outwardly projecting shaft 7 made of $Al_2O_3$, in which the electrode system is brazed, as a rule, with the aid of a vitreous braze or frit. These "projections" are necessary for the conventional current feedthroughs.

By using the electrode system according to the invention with a platinum group metal-based or Re-based current feedthrough, these ceramic "projections" can be eliminated or considerably shortened (see FIG. 2). In addition, the new electrode system forming the basis of this invention allows the lamps to operate at higher temperatures, which leads to better color reproduction and to higher light efficiency.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An electrode system for a discharge lamp comprising a ceramic discharge vessel (5) with a wall having a thickness, an electrode inside the vessel, a current feedthrough (2) being fed through the thickness of the wall of the discharge vessel (5), wherein the current feedthrough has a length that is essentially coextensive with the thickness of the vessel wall and projects no more than minimally into the discharge vessel, the current feedthrough (2) being brazed with a braze (4) into the wall of the discharge vessel, and a current supply line (3), wherein the current feedthrough (2) comprises a platinum-group metal and is brazed directly to the ceramic of the wall of the discharge vessel by the braze (4).

2. The electrode system according to claim 1, wherein the current supply line (3) comprises a current supply line pin.

3. The electrode system according to claim 1, wherein the current feedthrough (2) has a form of at least one sphere.

4. A method for producing an electrode system for a discharge lamp comprising a ceramic discharge vessel (5), an electrode (1), a platinum group metal-based or rhenium-based current feedthrough (2) through a thickness of a wall of the ceramic discharge vessel (5), wherein the current feedthrough has a length that is essentially coextensive with the thickness of the vessel wall and projects no more than minimally into the discharge vessel, and a current supply line (3), the method comprising brazing a platinum group metal-based braze (4) flush with the current feedthrough and the wall of the ceramic discharge vessel, the current feedthrough being brazed into the discharge vessel wall.

5. A ceramic discharge vessel (5) for a discharge lamp, the vessel having a wall with no significant wall widening at a current feedthrough (2) through location, wherein the current feedthrough has a length that is essentially coextensive with a thickness of the vessel wall and projects no more than minimally into the discharge vessel, wherein the current feedthrough (2) is brazed with a braze (4) into the discharge vessel wall and the current feedthrough comprises a platinum group metal-based or rhenium-based material.

6. A metal halide lamp comprising a ceramic discharge vessel (5) having a housing wall with no projecting shaft arranged in the wall in an area of a current feedthrough (2), the current feedthrough (2) being fed through and brazed into a thickness of the wall of the vessel (5), wherein the current feedthrough has a length that is essentially coextensive with the thickness of the vessel wall and projects no more than minimally into the discharge vessel, wherein the current feedthrough (2) of the vessel (5) comprises a platinum group metal-based or rhenium-based material.

* * * * *

UNITED STATES PATENT AND TRADEMARK OFFICE

CERTIFICATE OF CORRECTION

PATENT NO. : 7,602,115 B2
APPLICATION NO. : 11/090423
DATED : October 13, 2009
INVENTOR(S) : Weiland et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 808 days.

Signed and Sealed this

Fifth Day of October, 2010

David J. Kappos

David J. Kappos
*Director of the United States Patent and Trademark Office*